US008096159B2

(12) United States Patent
Kim et al.

(10) Patent No.: US 8,096,159 B2
(45) Date of Patent: Jan. 17, 2012

(54) APPARATUS AND METHOD FOR SUPPLYING LUBRICANT IN ENDLESS HOT ROLLING EQUIPMENT

(75) Inventors: Chul-Hee Kim, Pohang (KR); Seung-Lak Son, Pohang (KR)

(73) Assignee: Posco, Pohang (KR)

( * ) Notice: Subject to any disclaimer, the term of this patent is extended or adjusted under 35 U.S.C. 154(b) by 933 days.

(21) Appl. No.: 12/091,797

(22) PCT Filed: Nov. 7, 2006

(86) PCT No.: PCT/KR2006/004637

§ 371 (c)(1),
(2), (4) Date: Apr. 28, 2008

(87) PCT Pub. No.: WO2007/055503

PCT Pub. Date: May 18, 2007

(65) Prior Publication Data

US 2008/0257647 A1 Oct. 23, 2008

(30) Foreign Application Priority Data

Nov. 8, 2005 (KR) ..... 10-2005-0106347

(51) Int. Cl.
*B21B 27/06* (2006.01)

(52) U.S. Cl. ..... 72/201; 72/8.7; 72/11.9; 72/44; 72/236

(58) Field of Classification Search ..... 72/8.7, 72/9.3, 11.1, 11.9, 41, 201, 236, 42, 43, 44
See application file for complete search history.

(56) References Cited

U.S. PATENT DOCUMENTS

| | | | | |
|---|---|---|---|---|
| 3,837,199 | A * | 9/1974 | Larsonneur | 72/12.5 |
| 4,247,047 | A * | 1/1981 | Schaming | 239/391 |
| 4,510,784 | A * | 4/1985 | Hsu | 72/201 |
| 5,090,225 | A * | 2/1992 | Schimion | 72/45 |
| 5,799,523 | A * | 9/1998 | Seidel et al. | 72/9.3 |
| 6,062,056 | A * | 5/2000 | Groch | 72/201 |
| 6,490,903 | B2 * | 12/2002 | Ravenet et al. | 72/236 |
| 7,181,822 | B2 * | 2/2007 | Ondrovic et al. | 29/527.7 |
| 7,305,859 | B2 * | 12/2007 | Ootsuka et al. | 72/9.1 |
| 2004/0232258 | A1 | 11/2004 | Cerv et al. | |

FOREIGN PATENT DOCUMENTS

| | | | |
|---|---|---|---|
| DE | 10130445 | A1 | 1/2003 |
| JP | 57124512 | A | 8/1982 |
| JP | 58167018 | A | 10/1983 |
| JP | 59-24511 | * | 2/1984 |
| JP | 2-197309 | * | 8/1990 |

(Continued)

*Primary Examiner* — Edward Tolan
(74) *Attorney, Agent, or Firm* — The Webb Law Firm

(57) ABSTRACT

A lubricant supply apparatus for endless hot rolling equipment includes a width-detecting sensor for detecting widths of steel sheets continuously supplied toward a roller, a controller connected to the width-detecting sensor, a lubricant pump connected to and controlled by the controller to supply a lubricant to a lubricant line, solenoid valves disposed on sub lines formed by dividing the lubricant line and controlled by the controller to supply or cut off the lubricant, a water pump connected to and controlled by the controller to supply water to a water line, mixers for mixing the lubricant and the water supplied to the water line for each of the sub lines, and nozzles connected respectively to the mixers and disposed according to a width of the roller so as to spray a mixture onto the roller according to the widths of the steel sheets.

20 Claims, 6 Drawing Sheets

FOREIGN PATENT DOCUMENTS

| | | | |
|---|---|---|---|
| JP | 3128113 A | | 5/1991 |
| JP | 6-63636 | * | 3/1994 |
| JP | 08224612 A | | 9/1996 |
| JP | 2002282911 A | | 10/2002 |
| JP | 2002316202 A | | 10/2002 |
| JP | 2003181516 A | | 7/2003 |

* cited by examiner

[Fig. 1]
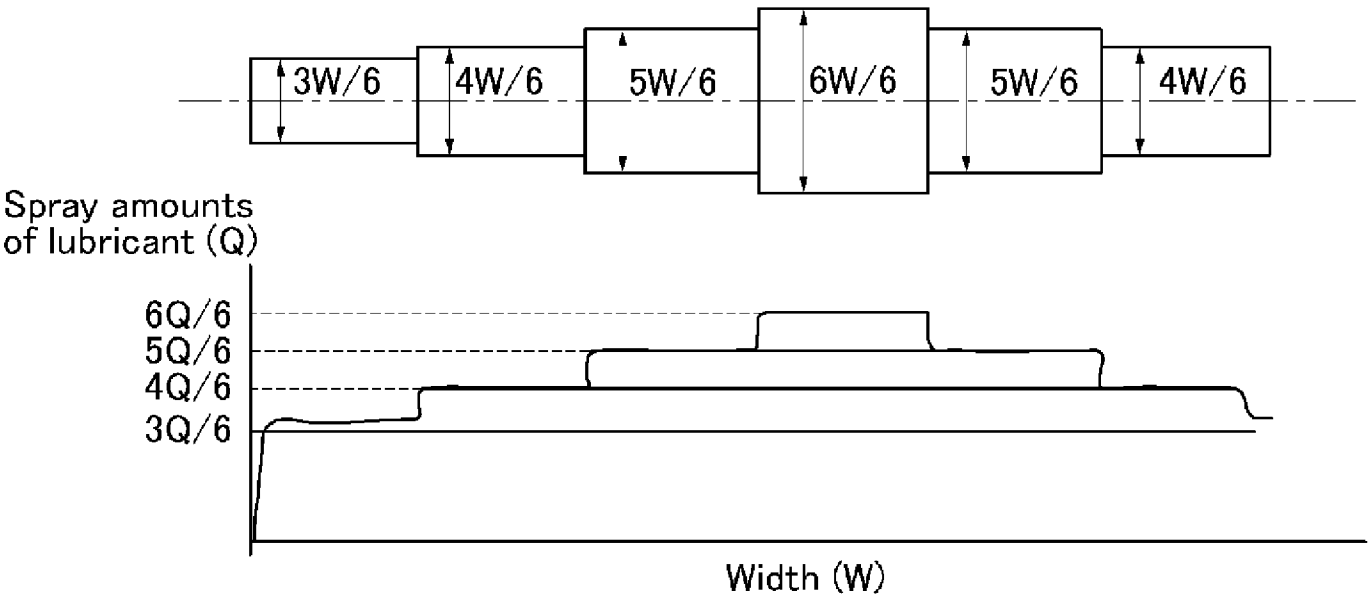

[Fig. 2]
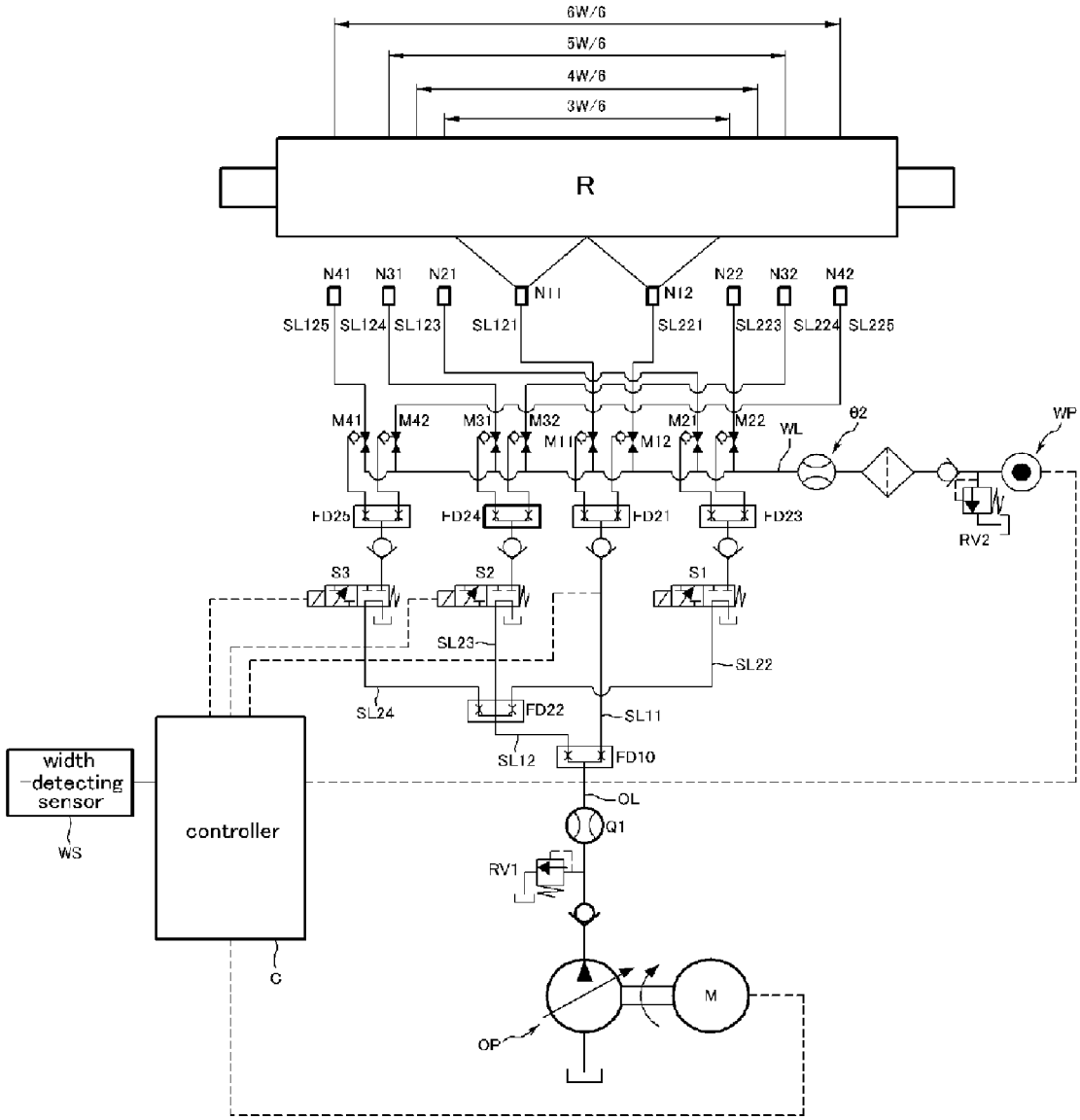

[Fig. 3]
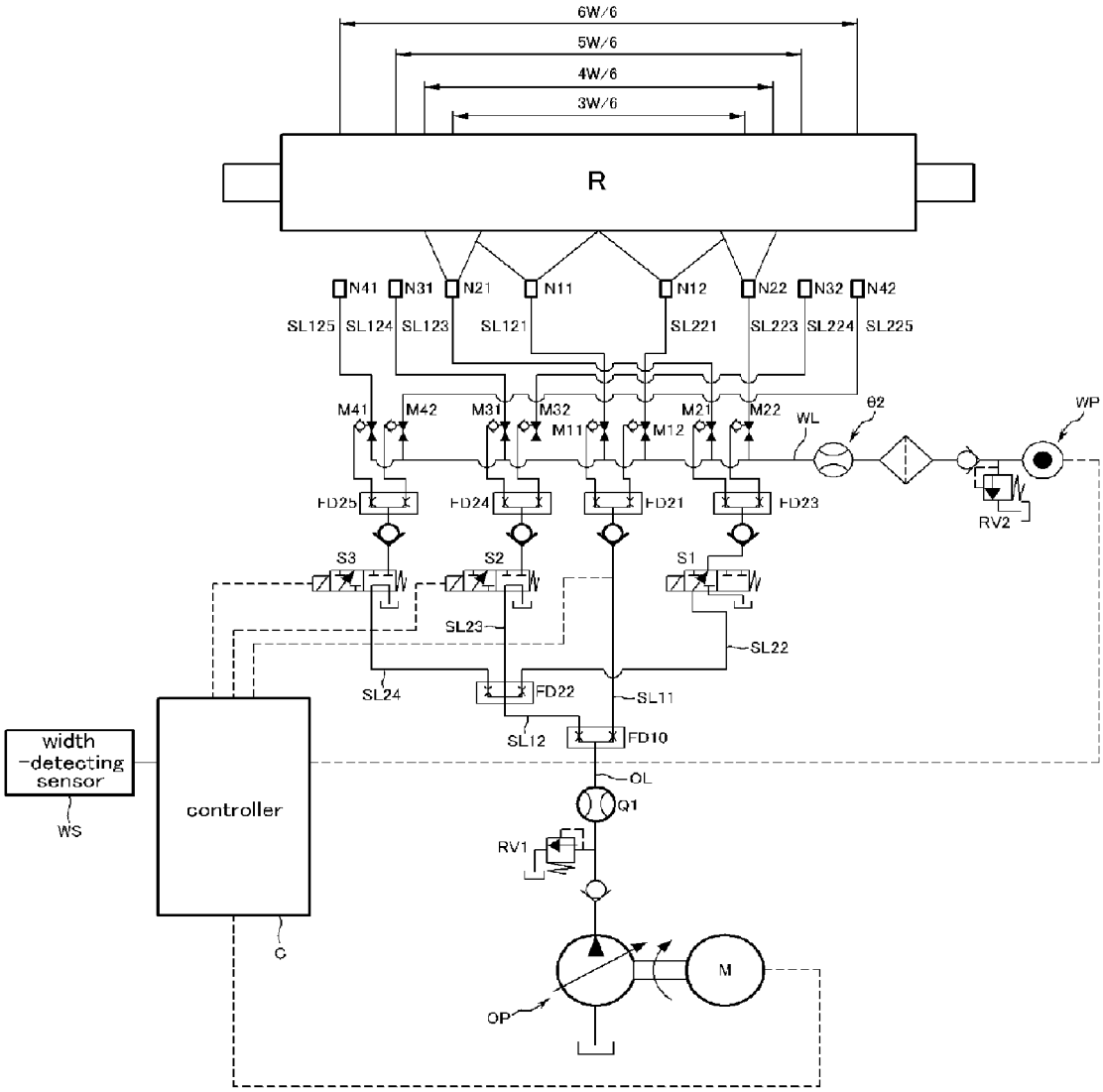

[Fig. 4]
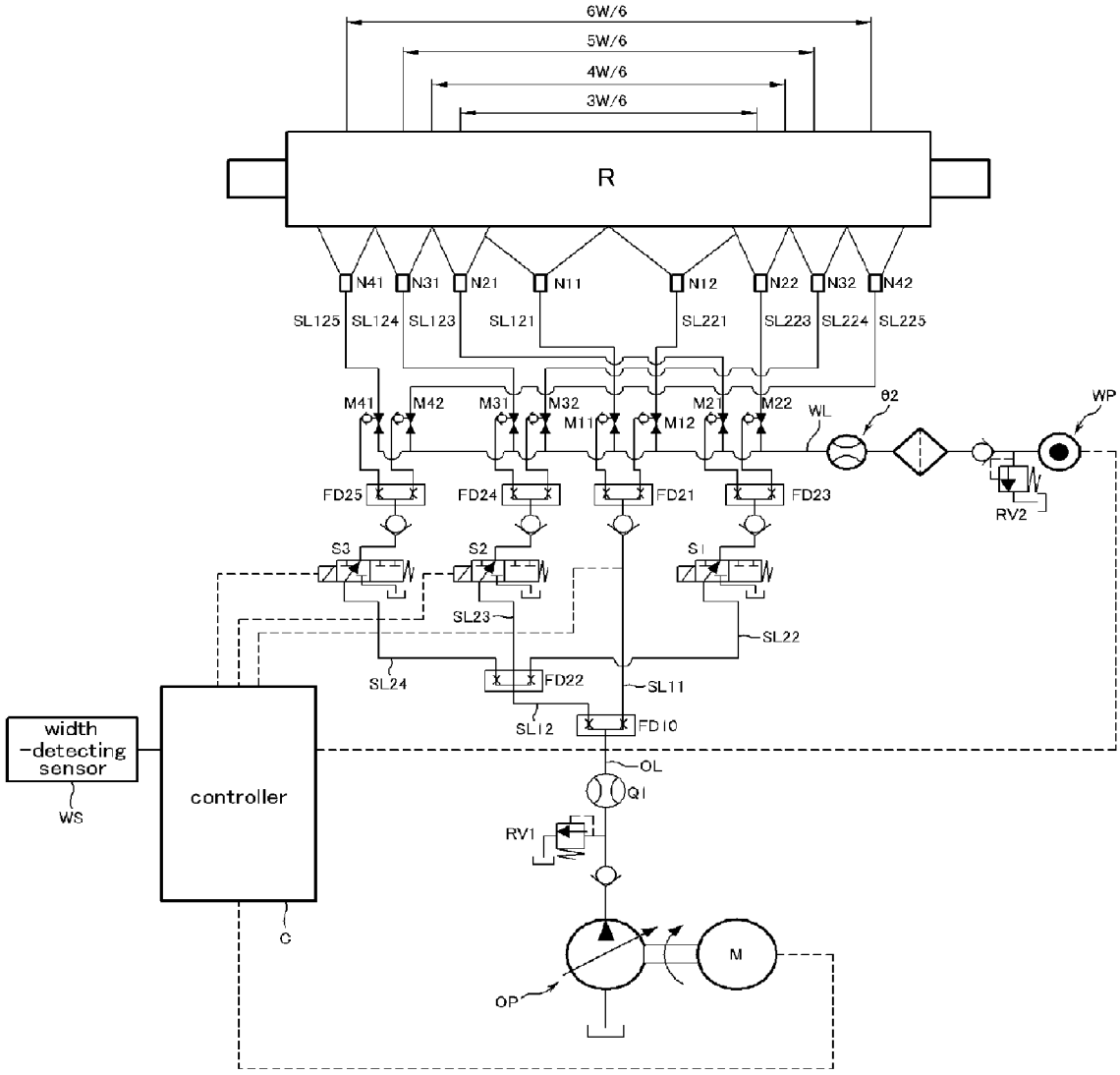

[Fig. 5]
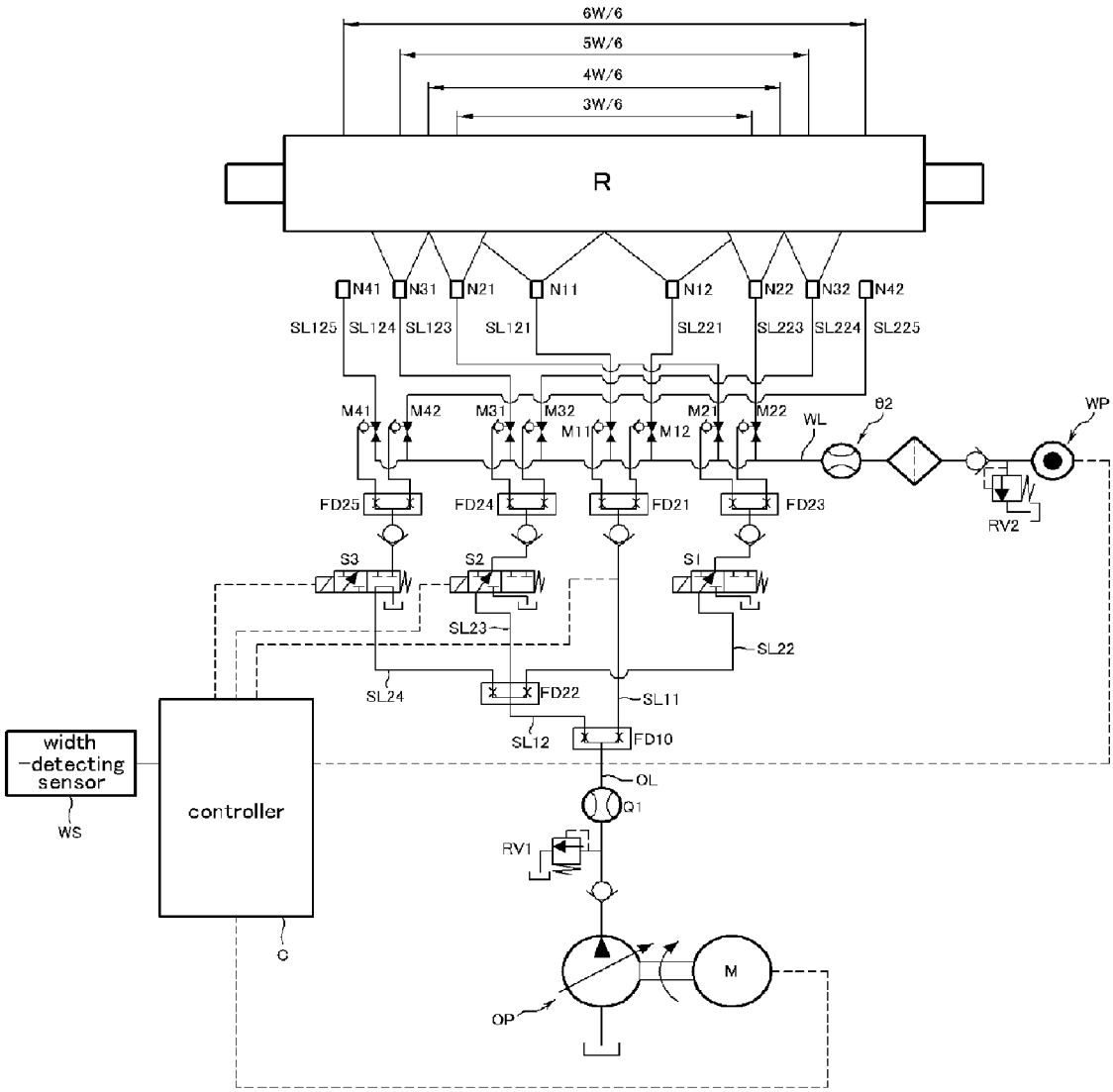

[Fig. 6]
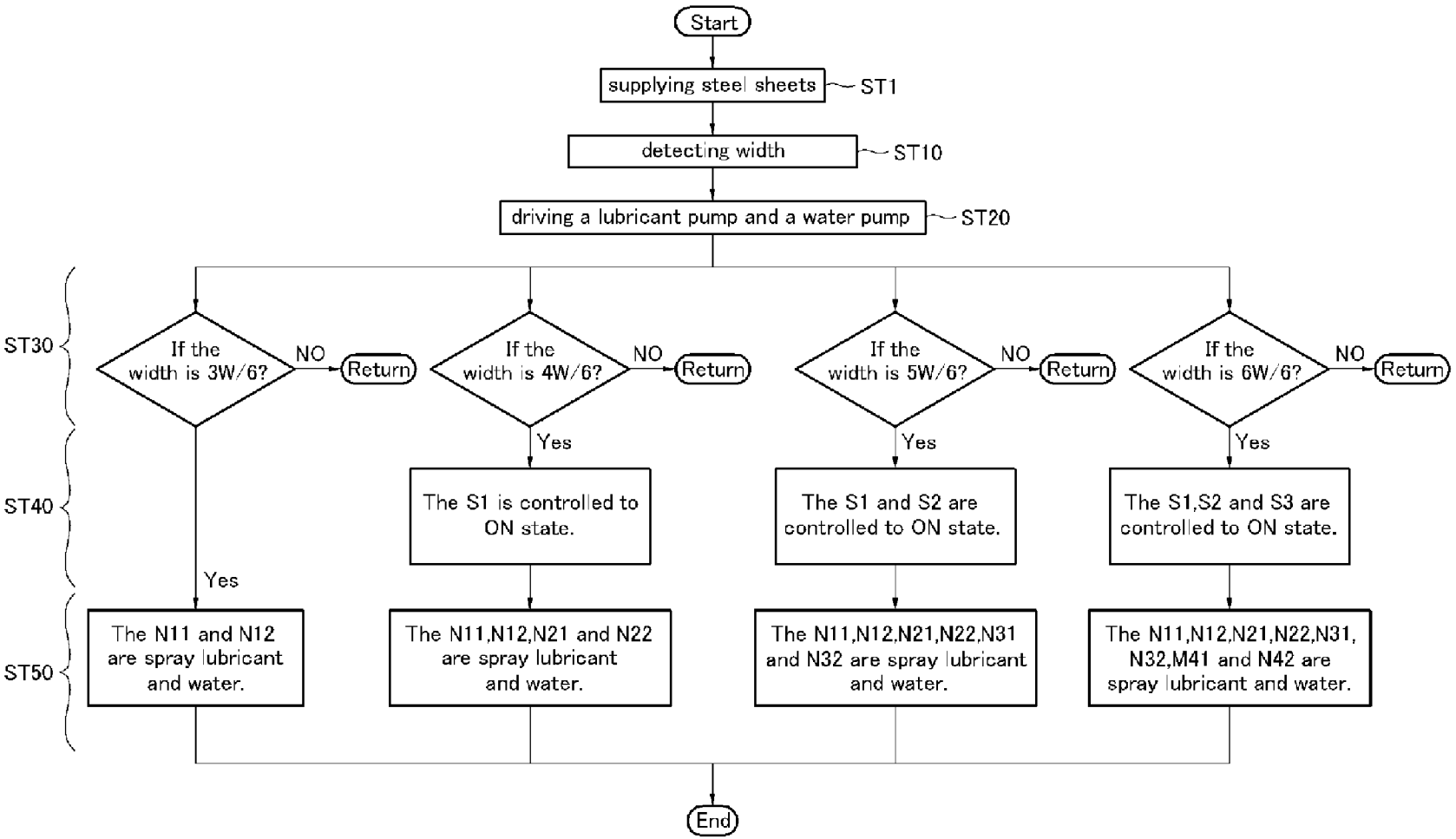

APPARATUS AND METHOD FOR SUPPLYING LUBRICANT IN ENDLESS HOT ROLLING EQUIPMENT

TECHNICAL FIELD

The present invention relates to an apparatus and method for supplying lubricant in endless hot rolling equipment, and more particularly to an apparatus and method for supplying lubricant in endless hot rolling equipment in which continuously supplied steel sheets of various widths may be effectively lubricated.

BACKGROUND ART

Generally, in a hot rolling process, continuous rolling refers to the process in which a trailing portion of a steel sheet that is undergoing rolling and a leading portion of a steel sheet to subsequently undergo rolling are joined to thereby continuously perform rolling. This is in contrast to the existing method by which steel sheets respectively rolled into coils are separately rolled.

Since steel sheets may be continuously rolled using the continuous rolling method (even if the coil is changed), productivity is improved. Further, quality defects encountered in the existing rolling process and occurring at the leading and trailing portions of the steel sheets may be significantly reduced.

In the process of hot rolling a steel sheet, it is necessary to increase the service life of a working roller by reducing the friction between the working roller and the steel sheet. The contact area between the working roller and the steel sheet is lubricated for this purpose. Water injection is used for such lubrication.

In the water injection method, an oil-water mixture in which a small amount of lubricant is diluted in a large amount of water is directly injected onto the working roller, or injected onto a reinforcing roller. When the mixture is injected onto the reinforcing roller, the mixture is transferred onto the working roller, which rotates together with the reinforcing roller through contact with the same, such that the mixture that comes to be coated on the working roller is ultimately supplied to the steel sheet that is being rolled. The lubricant included in the mixture is supplied to a circular arc gap between the steel sheet undergoing pressing and the working roller in contact therewith.

In order to spray a suitable amount of lubricant on a surface of the working roller, air atomizing and steam spraying may be used in addition to water injection. Furthermore, the lubricant used for rolling purposes may be a liquid lubricant, a gel grease, or a solid lubricant.

The lubrication method in hot rolling is performed as in the following and consideration of the limitations imposed as a result of performing rolling in batches. 1) Since slipping occurs when an excessive amount of lubricant is used, it is necessary to perform control such that the supply of lubricant is optimized. 2) Even when a single steel sheet is lubricated, the lubricant is not supplied to the entire length of the steel sheet being rolled, but rather, is supplied to only an area of the steel sheet excluding select sections of leading and trailing portions of the coil. 3) Lubricant is not continuously supplied, and instead, an intermittent lubrication method must be employed in which switching between supply and cut off is performed. 4) If an excessive amount of lubricant is supplied, a friction coefficient between the steel sheet and the working roll is disproportionately reduced such the steel sheet may not be able to pass through the rolling equipment. For these reasons, the lubrication method in conventional hot rolling is such that lubrication may only be passively performed.

Endless hot rolling, in which hot-rolled steel sheets are continuously connected at a front of a finishing mill and rolled, improves productivity as a result of reducing idle time. However, in endless rolling, the load on the working roller is increased when the reduction ratio and rolling speed are increased. As a result, heat fatigue of or wear on the roller occurs such that it becomes difficult to perform continuous rolling.

Japanese Laid-Open Patent No. 3-128113 is an example of a technique for supplying lubricant to a working roller in hot rolling. A lubricant supply apparatus is disclosed in this publication.

In this lubricant supply apparatus, a lubricant is mixed in warm water, and a nozzle is used to supply the mixture to a working roller. Further, in this lubricant supply apparatus, the lubricant and warm water are separately supplied through lines, and after the lubricant and warm water are mixed in a mixer, the mixture is sprayed onto the working roller through a spray nozzle mounted on a nozzle head. In addition, the supply of the lubricant may be cut off and only warm water supplied through the nozzle for spraying onto the working roller. Also, with the use of this lubricant supply apparatus, nozzle heads may be horizontally mounted spaced apart at equal intervals along the direction of the width of the steel sheet such that lubricant may be supplied to the entire width of the steel sheet.

In this lubricant supply apparatus, the nozzles mounted according to the width of the steel sheet may be individually controlled such that lubricant can be supplied to correspond to various different types of steel sheets of different widths. Lubricant and cold water are mixed immediately prior to spraying. Accordingly, after mixing and until spraying occurs, since the mixture passes through a short pipe, oil-water separation does not occur, and spray timing is excellent. However, there is a significant distance between a storage tank and the nozzle(s), thereby necessitating the use of a precise pump to control small amounts of lubricant. Hence, a precise oil pump is needed for each of the nozzles. Since the pipes are long and a large number of the nozzles are required in the lubricant supply apparatus, the piping is complicated. In addition, since pipes having a small diameter must be used, pressure loss of the pipes occurs, thereby making installation and maintenance of the equipment difficult.

In the conventional lubricant supply method, a precision metering pump is used to draw the lubricant from a storage tank to a mill stand. A mixture resulting from mixing the lubricant with cold or warm water is then sprayed onto the working roller through a nozzle head. In addition, in this method, spray timing is adjusted using a control valve mounted on the pipe that controls the supply and cut off of the mixture to the nozzle. However, while the equipment is simple in this method, as a result of the high temperatures involved in hot rolling, the mixer for mixing the lubricant and water and the control valve must be separated from the nozzle head by a considerable distance.

As a result of this structural problem, oil-water separation and spray timing delay problems are encountered with this method. Further, since a large amount of water is supplied when the lubricant and water are mixed, differences in the concentration of the mixture occur. In some instances, this may result in the lubricant not adhering well to the working roller.

Japanese Laid-Open Patent No. 2002-282911 discloses a technique for solving the problem of lubricant not adhering well to the surface of a roller due to differences in a concentration of a mixture. In the method of this patent, although an area of a pipe of a mixer for mixing water and lubricant is adjusted, the manner in which the area of the pipe is adjusted is not specifically disclosed.

Lubricant sprayed in accordance with a width of a steel sheet must be uniformly supplied by an amount that is in proportion to the width of the steel sheet. However, in the conventional lubricant supply method, differences in the concentration of the lubricant mixed with water according to spray area occur. Further, if a spray area is separated into a narrow region and a wide region for the supply of lubricant, although the equipment is simplified, mixture is wasted so that the consumption of lubricant is increased. In addition, if the spray area is subdivided, although it is possible to perform more precise control, the number of control valves is increased and the equipment becomes complicated.

In another lubricant supply method, lubricant amount is controlled individually by a nozzle and a supply pump. However, since small amounts of lubricant must be precisely controlled in this method, it is extremely difficult to dilute the lubricant at uniform concentrations in large amounts of water, and piping equipment as well as repair and maintenance are made difficult.

In yet another lubricant supply method, lubricant required for the entire roller is supplied all at once to a pump and diluted with water, after which the mixture is divided among nozzle heads. However, while the equipment is simple using this method, when lubricant is sprayed in a direction of a width of varying steel sheets, differences in a concentration of the lubricant along the width of the steel sheets are encountered.

In still yet another lubricant supply method, premixing is used. In this method, after water and lubricant are mixed in a mixer, the resulting mixture is divided among and supplied to nozzles mounted in each of the spray areas. However, although this method is suitable for use in rolling in which steel sheets are rolled one at a time, if it is necessary to perform lubrication when rolling steel sheets of differing widths, variations occur in the concentration of the lubricant along a width of the steel sheets to thereby result in uneven lubrication.

Japanese Laid-Open Patent No. 2002-282911 discloses a method for solving these problems. In this publication, areas of lubricant supply pipes connected to nozzles of each area are varied. However, the manner in which the areas of the pipes are adjusted is not specifically disclosed.

Accordingly, the conventional lubricant supply methods and apparatuses have many drawbacks that must be overcome to allow for suitable application to endless hot rolling in which steel sheets of different sizes and materials are connected and rolled.

The present invention provides an apparatus and method for supplying lubricant in endless hot rolling equipment, in which flaws on a surface of a steel sheet due to sticking between a working roller and a steel sheet during endless hot rolling are prevented, and wear in the working roller is minimized.

The present invention also provides an apparatus and method for supplying lubricant in endless hot rolling, in which continuous rolling may be performed by spraying lubricant in accordance with varying widths of steel sheets.

SUMMARY OF THE INVENTION

According to an exemplary embodiment of the present invention provides a lubricant supply apparatus for endless hot rolling equipment includes a width-detecting sensor for detecting widths of steel sheets continuously supplied toward a roller in the endless hot rolling equipment; a controller connected to the width-detecting sensor; a lubricant pump connected to and controlled by the controller to supply a lubricant to a lubricant line; a solenoid valve disposed on at least one of a plurality of sub lines formed by dividing the lubricant line, the solenoid valve being controlled by the controller so as to one of supply and cut off the supply of the lubricant; a water pump connected to and controlled by the controller to supply water to a water line; a plurality of mixers for mixing the lubricant and the water supplied to the water line respectively for each of the sub lines; and a plurality of nozzles connected respectively to the mixers and disposed according to a width of the roller so as to spray a mixture onto the roller according to the widths of the steel sheets.

The nozzles may include a fixed width nozzle disposed corresponding to a center portion of the steel sheets and spraying a large amount of the mixture, and variable width nozzles disposed outwardly of and sequentially from the fixed width nozzle and spraying a smaller amount of the lubricant than the fixed width nozzle.

The nozzles may be symmetrically arranged along the direction of the width of the steel sheets, and include large flow eleventh and twelfth nozzles disposed corresponding to a center position of the width of the steel sheets, a twenty-first nozzle, a thirty-first nozzle, and a forty-first nozzle disposed in this order to one side of the eleventh and twelfth nozzles, and a twenty-second nozzle, a thirty-second nozzle, and a forty-second nozzle disposed in this order to an opposite side of the eleventh and twelfth nozzles, the twenty-first, twenty-second, thirty-first, thirty-second, forty-first, and forty-second nozzles spraying a smaller amount of the lubricant than the eleventh and twelfth nozzles.

Rotary flow dividers may be disposed between the lubricant line and the sub lines.

The lubricant line may be divided into an eleventh sub line and a twelfth sub line by a tenth rotary flow divider.

The eleventh sub line may be divided into a one hundred twenty-first sub line and a two hundred twenty-first sub line by a twenty-first rotary flow divider, the one hundred twenty-first sub line and the two hundred twenty-first sub line being connected respectively to the eleventh nozzle and the twelfth nozzle which are positioned corresponding to a center position of the width of the steel sheets.

An eleventh mixer connected to the water line may be disposed between the one hundred twenty-first sub line and the eleventh nozzle, and a twelfth mixer connected to the water line is disposed between the two hundred twenty-first sub line and the twelfth nozzle.

The twelfth sub line may be divided into a twenty-second sub line, a twenty-third sub line, and a twenty-fourth sub line by a twenty-second rotary flow divider.

The twenty-second sub line is divided into a one hundred twenty-third sub line and a two hundred twenty-third sub line by a twenty-third rotary flow divider, the one hundred twenty-third sub line and the two hundred twenty-third sub line being connected respectively to a twenty-first nozzle and a twenty-second nozzle positioned outwardly of the eleventh nozzle and the twelfth nozzle, respectively.

A first solenoid valve may be disposed on the twenty-second sub line, the first solenoid valve being connected to the controller.

A twenty-first mixer connected to the water line may be disposed between the one hundred twenty-third sub line and the twenty-first nozzle, and a twenty-second mixer connected to the water line may be disposed between the two hundred twenty-third sub line and the twenty-second nozzle.

The twenty-third sub line may be divided into a one hundred twenty-fourth sub line and a two hundred twenty-fourth sub line by a twenty-fourth rotary flow divider, the one hundred twenty-fourth sub line and the two hundred twenty-fourth sub line being connected respectively to a thirty-first nozzle and a thirty-second nozzle positioned outwardly of the twenty-first nozzle and the twenty-second nozzle, respectively.

A second solenoid valve may be disposed on the twenty-third sub line, the second solenoid valve being connected to the controller.

A thirty-first mixer connected to the water line may be disposed between the one hundred twenty-fourth sub line and the thirty-first nozzle, and a thirty-second mixer connected to the water line may be disposed between the two hundred twenty-fourth sub line and the thirty-second nozzle.

The twenty-fourth sub line may be divided into a one hundred twenty-fifth sub line and a two hundred twenty-fifth sub line by a twenty-fifth rotary flow divider, the one hundred twenty-fifth sub line and the two hundred twenty-fifth sub line being connected respectively to a forty-first nozzle and a forty-second nozzle positioned outwardly of the thirty-first nozzle and the thirty-second nozzle, respectively.

A third solenoid valve may be disposed on the twenty-fourth sub line, the third solenoid valve being connected to the controller.

A forty-first mixer connected to the water line may be disposed between the one hundred twenty-fifth sub line and the forty-first nozzle, and a forty-second mixer connected to the water line is disposed between the two hundred twenty-fifth sub line and the forty-second nozzle.

According to another exemplary embodiment of the present invention, a lubricant supply method for endless hot rolling equipment including the lubricant supply apparatus includes: (a) detecting widths of steel sheets continuously supplied toward a roller; (b) driving a lubricant pump and a water pump according to detection signals; (c) determining widths of the steel sheets according to the detection signals; (d) on and off controlling solenoid valves disposed on sub lines that connect a lubricant line to each of the nozzles such that lubricant is sprayed from the nozzles positioned corresponding to the widths of the steel sheets; and (e) mixing the lubricant and water and spraying a resulting mixture through corresponding ones of the nozzles.

In step (c), it is determined if each of the widths (W) of the steel sheets may be one of 3W/6, 4W/6, 5W/6, and 6W/6.

In step (d), if the width of one of the steel sheets is 3W/6, first, second, and third solenoid valves may be controlled to off states, if the width of one of the steel sheets is 4W/6, the first solenoid valve is controlled to an on state, while the second and third solenoid valves are controlled to off states, if the width of one of the steel sheets is 5W/6, the first and second solenoid valves are controlled to on states, while the third solenoid valve is controlled to an off state, and if the width of one of the steel sheets is 6W/6, the first, second, and third solenoid valves are controlled to on states.

In the exemplary embodiment of the present invention, optimal lubrication is possible such that flaws on a surface of steel sheets due to sticking between the roller and the steel sheets during endless hot rolling are prevented.

Further, with the use of the apparatus for supplying lubricant of the exemplary embodiment of the present invention to perform hot rolling, optimal lubrication is possible such that wear in the roller is minimized, even after rolling of a large number of steel sheets is performed.

In addition, with the use of the apparatus for supplying lubricant of the exemplary embodiment of the present invention to perform hot rolling, lubricant is sprayed in accordance with varying widths of the steel sheets such that the consumption of lubricant is significantly reduced. As a result, the number of the steel sheets that may be continuously rolled may be increased to thereby enhance productivity.

BRIEF DESCRIPTION OF THE DRAWINGS

FIG. 1 shows the relation between varying widths of steel sheets passing through endless hot rolling equipment and spray amounts of lubricant;

FIG. 2 is a hydraulic circuit diagram of a lubricant supply apparatus for endless hot rolling equipment according to an exemplary embodiment of the present invention, illustrating a control state for spraying lubricant corresponding to a steel sheet of a 3W/6 width size;

FIG. 3 shows a control state for spraying lubricant corresponding to a steel sheet of a 4W/6 width size;

FIG. 4 shows a control state for spraying lubricant corresponding to a steel sheet of a 5W/6 width size;

FIG. 5 shows a control state for spraying lubricant corresponding to a steel sheet of a 6W/6 width size; and FIG. 6 is a flow chart of a lubricant supply method for endless hot rolling equipment according to an exemplary embodiment of the present invention.

DETAILED DESCRIPTION OF THE INVENTION

Reference will now be made in detail to exemplary embodiments of the present invention, examples of which are illustrated in the accompanying drawings.

FIG. 1 shows the relation between varying widths of steel sheets passing through endless hot rolling equipment and spray amounts of lubricant, and FIG. 2 is a hydraulic circuit diagram of a lubricant supply apparatus for endless hot rolling equipment according to an exemplary embodiment of the present invention, illustrating a control state for spraying lubricant corresponding to a steel sheet of a 3W/6 width size.

With reference to the drawings, steel sheets passing through endless hot rolling equipment may have a width (W) of varying size. That is, for a maximum width W corresponding to a roller (R), steel sheets may have varying sizes of widths of 3W/6, 4W/6, 5W/6, or 6W/6. The size of the width (W) determines the manner in which lubricant is controlled for spraying onto the roller (R) along the direction of the width (W).

Accordingly, the size of the width (W) is established within a range that allows for hot rolling of steel sheets to be performed smoothly while minimizing a structure of the apparatus and consumption of lubricant. A leading portion of a steel sheet to undergo hot rolling is joined to a trailing portion of a steel sheet undergoing hot rolling. The two steel sheets may have the same width or different widths.

The lubricant supply apparatus of this exemplary embodiment sprays lubricant during an endless rolling process in a manner corresponding to the widths of steel sheets, even when the widths of the steel sheets vary, and such that areas outside of the widths of the steel sheets are not sprayed, thereby minimizing the consumption of lubricant.

The lubricant supply apparatus of this exemplary embodiment includes a width-detecting sensor (WS), a controller (C), a lubricant pump (OP), a first solenoid valve (S1), a second solenoid valve (S2), a third solenoid valve (S3), a water pump (WP), an eleventh mixer (M11), a twelfth mixer (M12), a twenty-first mixer (M21), a twenty-second mixer (M22), a thirty-first mixer (M31), a thirty-second mixer (M32), a forty-first mixer (M41), a forty-second mixer (M42), an eleventh nozzle (N11), a twelfth nozzle (N12), a twenty-first nozzle (N21), a twenty-second nozzle (N22), a thirty-first nozzle (N31), a thirty-second nozzle (N32), a forty-first nozzle (N41), and a forty-second nozzle (N42).

The width-detecting sensor (WS) is disposed at a location where steel sheets are supplied to allow for detection of the width (W) of the steel sheets continuously supplied toward the roller (R) in the hot rolling equipment. The width-detecting sensor (WS) is connected to an input end of the controller (C) for input of width detection signals thereto.

The controller (C) determines the widths of steel sheets using the width detection signals, and controls the lubricant pump (OP) and the water pump (WP), which are connected to an output terminal of the controller (C), and selectively controls the first solenoid valve (S1), the second solenoid valve (S2), and the third solenoid valve (S3). Since the controller (C) may be realized through a typical computer system, a detailed description thereof will not be provided.

The lubricant pump (OP) is connected to a lubricant line (OL), and is controlled by the controller (C) to supply lubricant to the lubricant line (OL). The lubricant pump (OP) includes a precision flow control pump to precisely supply oil. Provided on the lubricant line (OL) connected to the lubricant pump (OP) are a relief valve (RV1), and a first flow meter (Q1) for detecting lubricant amounts. Accordingly, the lubricant line (OL) supplies predetermined amounts of lubricant.

Further, the water pump (WP) is connected to a water line (WL), and is controlled by the controller (C) to supply water to the water line (WL). Provided on the water line (WL) connected to the water pump (WP) are a second relief valve (RV2), and a second flow meter (Q2) for detecting water amounts. Accordingly, the water line (WL) supplies predetermined amounts of water.

The lubricant line (OL), so as to supply a predetermined amount of lubricant to each of the eleventh nozzle (N11), the twelfth nozzle (N12), the twenty-first nozzle (N21), the twenty-second nozzle (N22), the thirty-first nozzle (N31), the thirty-second nozzle (N32), the forty-first nozzle (N41), and the forty-second nozzle (N42), is connected to and divided into a plurality of sub lines (SL) through rotary flow dividers (FD). That is, the rotary flow dividers (FD) are disposed between the lubricant line (OL) and the sub lines (SL). The rotary flow dividers (FD) are of the gear type, and distribute lubricant in equal amounts to the sub lines (SL) which are branched out from the lubricant line (OL). The first, second, and third solenoid valves (S1, S2, S3) disposed on the sub lines (SL) are on and off controlled so as to allow for the supply of lubricant flowing through the lubricant line (OL) in accordance with the widths (W) of the steel sheets.

The arrangement of the rotary flow dividers (FD) and the sub lines (SL), and the connecting relationship therebetween may be realized in a variety of ways. This will be described with reference to FIG. 2 and specific reference numerals.

A tenth rotary flow divider (FD10) is disposed on the lubricant line (OL). The lubricant line (OL) is divided into an eleventh sub line (SL11) and a twelfth sub line (SL12) by the tenth rotary flow divider (FD10). The tenth rotary flow divider (FD10) divides an entire flow amount (Q) of the lubricant supplied to the lubricant line (OL) equally into 3Q/6 amounts for supply to the eleventh sub line (SL11) and the twelfth sub line (SL12).

A twenty-first rotary flow divider (FD21) is disposed on the eleventh sub line (SL11). The eleventh sub line (SL11) is divided into a one hundred twenty-first sub line (SL121) and a two hundred twenty-first sub line (SL221) by the twenty-first rotary flow divider (FD21). The twenty-first rotary flow divider (FD21) divides the flow amount 3Q/6 of the lubricant supplied to the eleventh sub line (SL11) again in equal half amounts.

The eleventh nozzle (N11) and the twelfth nozzle (N12) are respectively connected to the one hundred twenty-first sub line (SL121) and the two hundred twenty-first sub line (SL221). The eleventh nozzle (N11) and the twelfth nozzle (N12) are disposed at a center location along a width direction of the steel sheets to correspond to a minimum width such that during operation of the lubricant pump (OP), lubricant is always sprayed therefrom.

Further, the eleventh mixer (M11) is disposed immediately downstream from the eleventh nozzle (N11) of the one hundred twenty-first sub line (SL121). The eleventh mixer (M11) is further connected to the water line (WL). The twelfth mixer (M12) is disposed immediately downstream from the twelfth nozzle (N12) of the two hundred twenty-first sub line (SL221). The twelfth mixer (M12) is further connected to the water line (WL). The water pump (WP) is connected to the water line (WL) such that water is continuously supplied when the water pump (WP) is operating.

The eleventh mixer (M11) and the twelfth mixer (M12) are disposed immediately downstream from the eleventh nozzle (N11) and the twelfth nozzle (N12), respectively, such that a mixture, in which lubricant and water supplied by pre-determined amounts are mixed at a uniform concentration, is sprayed onto a central portion of the roller (R). That is, since there is a short distance between the eleventh nozzle (N11) and the eleventh mixer (M11), and between the twelfth nozzle (N12) and the twelfth mixer (M12), the mixture is maintained at a uniform concentration from mixture to spraying.

When the width of the steel sheet supplied to the roller (R) is 3W/6, lubricant is supplied through only the mixture sprayed through the eleventh nozzle (N11) and the twelfth nozzle (N12). At this time, the lubricant supplied through the twelfth sub line (SL12) is cut off by the first, second, and third solenoid valves (S1, S2, S3) to thereby prevent the consumption of unneeded lubricant.

Further, the twenty-first nozzle (N21) and the twenty-second nozzle (N22), the thirty-first nozzle (N31) and the thirty-second nozzle (N32), and the forty-first nozzle (N41) and the forty-second nozzle (N42) spray only water supplied through the water line (WL). As a result, blockage of the nozzles not spraying lubricant is prevented, and separate solenoid valves for cutting off the supply of water are unneeded to thereby simplify the equipment. In FIG. 2, only the spraying of the mixture containing lubricant is illustrated while the spraying of water is not shown.

The eleventh nozzle (N11) and the twelfth nozzle (N12) spray 3Q/6 of the lubricant entire flow amount (Q), and the remaining nozzles—the twenty-first nozzle (N21) and the twenty-second nozzle (N22), the thirty-first nozzle (N31) and the thirty-second nozzle (N32), and the forty-first nozzle (N41) and the forty-second nozzle (N42)-spray 3Q/6 of the lubricant entire flow amount (Q). As a result, the eleventh and twelfth nozzles (N11, N12) are realized through large flow nozzles, and since they are continuously spraying lubricant, operate as fixed width nozzles disposed at a center position of the steel sheets.

Further, the twenty-first nozzle (N21) and the twenty-second nozzle (N22), the thirty-first nozzle (N31) and the thirty-second nozzle (N32), and the forty-first nozzle (N41) and the forty-second nozzle (N42) are disposed outwardly of and sequentially from the fixed width nozzles to spray lubricant selectively according to the widths of the steel sheets, and thereby operate as variable width nozzles. Since these nozzles spray 3Q/6 of the lubricant entire flow amount (Q), they are small flow nozzles compared to the eleventh and twelfth nozzles (N11, N12).

The nozzles are symmetrically arranged along the direction of the width of the steel sheets. That is, the eleventh and twelfth nozzles (N11, N12) are disposed at a center position, the twenty-first nozzle (N21), the thirty-first nozzle (N31), and the forty-first nozzle (N41) are disposed in this order to one side of the eleventh and twelfth nozzles (N11, N12), and the twenty-second nozzle (N22), the thirty-second nozzle (N32), and the forty-second nozzle (N42) are disposed in this order to the other side of the eleventh and twelfth nozzles (N11, N12).

FIG. 3 shows a control state for spraying lubricant corresponding to a steel sheet of a 4W/6 width size.

The spraying of lubricant of 3Q/6 corresponding to an area of 3W/6 is described above with reference to FIG. 2. In this case, lubricant in the amount of 1Q/6 is further sprayed through the twenty-first nozzle (N21) and the twenty-second nozzle (N22) to an area greater than in FIG. 2 by 1W/6.

A twenty-second rotary flow divider (FD22) is disposed on the twelfth sub line (SL12). The twelfth sub line (SL12) is divided into a twenty-second sub line (SL22), a twenty-third sub line (SL23), and a twenty-fourth sub line (SL24) by the twenty-second rotary flow divider (FD22). The twenty-second rotary flow divider (FD22) divides the flow amount 3Q/6 of the lubricant supplied to the twelfth sub line (SL12) in equal one-third amounts.

A twenty-third rotary flow divider (FD23) is disposed on the twenty-second sub line (SL22). The twenty-second sub line (SL22) is divided into a one hundred twenty-third sub line (SL123) and a two hundred twenty-third sub line (SL223). The twenty-third rotary flow divider (FD23) divides the flow amount 1Q/6 of the lubricant supplied to the twenty-second sub line (SL22) in equal one-half amounts.

The twenty-first nozzle (N21) and the twenty-second nozzle (N22) are respectively connected to the one hundred twenty-third sub line (SL123) and the two hundred twenty-third sub line (SL223). The twenty-first nozzle (N21) and the twenty-second nozzle (N22) are disposed outwardly and respectively of the eleventh nozzle (N11) and the twelfth nozzle (N12) along the direction of the width of the steel sheets to thereby spray lubricant in the amount of 1Q/6 at an additional 1W/6 portion of the steel sheets. The twenty-first nozzle (N21) and the twenty-second nozzle (N22) spray lubricant only when the width of the steel sheets is 4W/6 or greater.

To realize the above, the first solenoid valve (S1) is disposed on the twenty-second sub line (SL22). The first solenoid valve (S1) is on and off controlled according to the detection signals of the width-detecting sensor (WS) which is connected to the controller (C).

Further, the twenty-first mixer (M21) is disposed immediately downstream from the twenty-first nozzle (N21) of the one hundred twenty-third sub line (SL123). The twenty-first mixer (M21) is further connected to the water line (WL). The twenty-second mixer (M22) is disposed immediately downstream from the twenty-second nozzle (N22) of the two hundred twenty-third sub line (SL223). The twenty-second mixer (M22) is further connected to the water line (WL). The water pump (WP) is connected to the water line (WL) such that water is continuously supplied when the water pump (WP) is operating.

The twenty-first mixer (M21) and the twenty-second mixer (M22) are disposed immediately downstream from the twenty-first nozzle (N21) and the twenty-second nozzle (N22), respectively, such that a mixture, in which lubricant and water supplied by predetermined amounts are mixed at a uniform concentration, is sprayed onto portions adjacent to portions sprayed by the eleventh nozzle (N11) and the twelfth nozzle (N12). That is, since there is a short distance between the twenty-first nozzle (N21) and the twenty-first mixer (M21), and between the twenty-second nozzle (N22) and the twenty-second mixer (M22), the mixture is maintained at a uniform concentration from mixture to spraying.

When the width of the steel sheet supplied to the roller (R) is 4W/6 corresponding to 3W/6 with an additional 1W/6, lubricant is supplied through only the mixture sprayed through the eleventh nozzle (N11) and the twelfth nozzle (N12), and through only the mixture sprayed through the twenty-first nozzle (N21) and the twenty-second nozzle (N22). At this time, the lubricant supplied through the twenty-third sub line (SL23) and the twenty-fourth sub line (SL24) is cut off by the second and third solenoid valves (S2, S3) to thereby prevent the consumption of unneeded lubricant.

Further, the thirty-first nozzle (N31) and the thirty-second nozzle (N32), and the forty-first nozzle (N41) and the forty-second nozzle (N42) spray only water supplied through the water line (WL). As a result, blockage of the nozzles not spraying lubricant is prevented, and separate solenoid valves for cutting off the supply of water are unneeded to thereby simplify the equipment. In FIG. 3, only the spraying of the mixture containing lubricant is illustrated while the spraying of water is not shown.

FIG. 4 shows a control state for spraying lubricant corresponding to a steel sheet of a 5W/6 width size.

The spraying of lubricant of 4Q/6 (3Q/6+1Q/6) corresponding to an area of 4W/6 (3W/6+1W/6) is described above with reference to FIGS. 2 and 3. In this case, lubricant in the amount of 1Q/6 is further sprayed through the thirty-first nozzle (N31) and the thirty-second nozzle (N32) to an area greater than in FIG. 3 by 1W/6.

A twenty-fourth rotary flow divider (FD24) is disposed on the twenty-third sub line (SL23). The twenty-third sub line (SL23) is divided into a one hundred twenty-fourth sub line (SL124) and a two hundred twenty-fourth sub line (SL224) by the twenty-fourth rotary flow divider (FD24). The twenty-fourth rotary flow divider (FD24) divides the flow amount 1Q/6 of the lubricant supplied to the twenty-third sub line (SL23) in equal one-half amounts.

The thirty-first nozzle (N31) and the thirty-second nozzle (N32) are respectively connected to the one hundred twenty-fourth sub line (SL124) and the two hundred twenty-fourth sub line (SL224). The thirty-first nozzle (N31) and the thirty-second nozzle (N32) are disposed outwardly and respectively of the twenty-first nozzle (N21) and the twenty-second nozzle (N22) along the direction of the width of the steel sheets to thereby spray lubricant in the amount of 1Q/6 at an additional 1W/6 portion of the steel sheets. The thirty-first nozzle (N31) and the thirty-second nozzle (N32) spray lubricant only when the width of the steel sheets is 5W/6 or greater.

To realize the above, the second solenoid valve (S2) is disposed on the twenty-third sub line (SL23). The second solenoid valve (S2) is on and off controlled according to the detection signals of the width-detecting sensor (WS) which is connected to the controller (C).

Further, the thirty-first mixer (M31) is disposed immediately downstream from the thirty-first nozzle (N31) of the one hundred twenty-fourth sub line (SL124). The thirty-first mixer (M31) is further connected to the water line (WL). The thirty-second mixer (M32) is disposed immediately downstream from the thirty-second nozzle (N32) of the two hundred twenty-fourth sub line (SL224). The thirty-second mixer (M32) is further connected to the water line (WL). The water pump (WP) is connected to the water line (WL) such that water is continuously supplied when the water pump (WP) is operating.

The thirty-first mixer (M31) and the thirty-second mixer (M32) are disposed immediately downstream from the thirty-first nozzle (N31) and the thirty-second nozzle (N32), respectively, such that a mixture, in which lubricant and water supplied by pre-determined amounts are mixed at a uniform concentration, is sprayed onto portions adjacent to portions sprayed by the twenty-first nozzle (N21) and the twenty-second nozzle (N22). That is, since there is a short distance between the thirty-first nozzle (N31) and the thirty-first mixer (M31), and between the thirty-second nozzle (N32) and the thirty-second mixer (M32), the mixture is maintained at a uniform concentration from mixture to spraying.

When the width of the steel sheet supplied to the roller (R) is 5W/6 corresponding to 3W/6 with additional 1W/6 and 1W/6, lubricant is supplied through the mixture sprayed through the eleventh nozzle (N11) and the twelfth nozzle (N12), through the mixture sprayed through the twenty-first nozzle (N21) and the twenty-second nozzle (N22), and through the mixture sprayed through the thirty-first nozzle (N31) and the thirty-second nozzle (N32). At this time, the lubricant supplied through the twenty-fourth sub line (SL24) is cut off by the third solenoid valve (S2) to thereby prevent the consumption of unneeded lubricant.

Further, the forty-first nozzle (N41) and the forty-second nozzle (N42) spray only water supplied through the water line (WL). As a result, blockage of the nozzles not spraying lubricant is prevented, and separate solenoid valves for cutting off the supply of water are unneeded to thereby simplify the equipment. In FIG. 4, only the spraying of the mixture containing lubricant is illustrated while the spraying of water is not shown.

FIG. 5 shows a control state for spraying lubricant corresponding to a steel sheet of a 6W/6 width size.

The spraying of lubricant of 5Q/6 (3Q/6+1Q/6+1Q/6) corresponding to an area of 5W/6 (3W/6+1W/6+1W/6) is described above with reference to FIGS. 2, 3, and 4. In this case, lubricant in the amount of 1Q/6 is further sprayed through the forty-first nozzle (N41) and the forty-second nozzle (N42) to an area greater than in FIG. 4 by 1W/6.

A twenty-fifth rotary flow divider (FD25) is disposed on the twenty-fourth sub line (SL24). The twenty-fourth sub line (SL24) is divided into a one hundred twenty-fifth sub line (SL125) and a two hundred twenty-fifth sub line (SL225) by the twenty-fifth rotary flow divider (FD25). The twenty-fifth rotary flow divider (FD25) divides the flow amount 1Q/6 of the lubricant supplied to the twenty-fourth sub line (SL24) again in equal one-half amounts.

The forty-first nozzle (N41) and the forty-second nozzle (N42) are respectively connected to the one hundred twenty-fifth sub line (SL125) and the two hundred twenty-fifth sub line (SL225). The forty-first nozzle (N41) and the forty-second nozzle (N42) are disposed outwardly and respectively of the thirty-first nozzle (N31) and the thirty-second nozzle (N32) along the direction of the width of the steel sheets to thereby spray lubricant in the amount of 1Q/6 at an additional 1W/6 portion of the steel sheets. The forty-first nozzle (N41) and the forty-second nozzle (N42) spray lubricant only when the width of the steel sheets is 6W/6 or greater.

To realize the above, the third solenoid valve (S3) is disposed on the twenty-fourth sub line (SL24). The third solenoid valve (S3) is on and off controlled according to the detection signals of the width-detecting sensor (WS) which is connected to the controller (C).

Further, the forty-first mixer (M41) is disposed immediately downstream from the forty-first nozzle (N41) of the one hundred twenty-fifth sub line (SL125). The forty-first mixer (M41) is further connected to the water line (WL). The forty-second mixer (M42) is disposed immediately downstream from the forty-second nozzle (N42) of the two hundred twenty-fifth sub line (SL225). The forty-second mixer (M42) is further connected to the water line (WL). The water pump (WP) is connected to the water line (WL) such that water is continuously supplied when the water pump (WP) is operating.

The forty-first mixer (M41) and the forty-second mixer (M42) are disposed immediately downstream from the forty-first nozzle (N41) and the forty-second nozzle (N42), respectively, such that a mixture, in which lubricant and water supplied by pre-determined amounts are mixed at a uniform concentration, is sprayed onto portions adjacent to portions sprayed by the thirty-first nozzle (N31) and the thirty-second nozzle (N32). That is, since there is a short distance between the forty-first nozzle (N41) and the forty-first mixer (M41), and between the forty-second nozzle (N42) and the forty-second mixer (M42), the mixture is maintained at a uniform concentration from mixture to spraying.

When the width of the steel sheet supplied to the roller (R) is 6W/6 corresponding to 3W/6 with additional 1W/6 and 1W/6 and 1W/6, lubricant is supplied through the mixture sprayed through the eleventh nozzle (N11) and the twelfth nozzle (N12), through the mixture sprayed through the twenty-first nozzle (N21) and the twenty-second nozzle (N22), through the mixture sprayed through the thirty-first nozzle (N31) and the thirty-second nozzle (N32), and through the mixture sprayed through the forty-first nozzle (N41) and the forty-second nozzle (N42). FIG. 5 illustrates the situation in which the mixture containing lubricant is sprayed through all the nozzles.

FIG. 6 is a flow chart of a lubricant supply method for endless hot rolling equipment according to an exemplary embodiment of the present invention.

A method for supplying lubricant using the lubricant supply apparatus structured and controlled as described above will now be described with reference to FIG. 6.

The lubricant supply method includes continuously supplying steel sheets toward the roller (R) of endless hot rolling equipment in step ST1, and detecting widths of the supplied steel sheets in step ST10. The width-detecting sensor (WS) detects the widths of the steel sheets passing through the hot rolling equipment, and transmits the resulting signals to the controller (C).

The controller (C) drives the lubricant pump (OP) and the water pump (WC) according to the width detection signals in step ST20. The lubricant pump (OP) and the water pump (WP) are driven continuously while the steel sheets are passed through the hot rolling equipment such that lubricant and water are supplied respectively to the lubricant line (OL) and the water line (WL).

Further, the controller (C) determines the widths (W) of the steel sheets using the width detection signals in step ST30. In this exemplary embodiment, the controller (C) determines whether the widths of the steel sheets are a maximum W, 5W/6, 4W/6, or a minimum 3W/6.

According to this determination, in step ST40, the controller (C) selectively on and off controls the first, second, and third solenoid valves (S1, S2, S3) disposed on the sub lines that connect the lubricant line (OL) to each of the nozzles such that lubricant is sprayed from the nozzles corresponding to the widths of the steel sheets.

In step ST40, if the width of a steel sheet is 3W/6, the first, second, and third solenoid valves (S1, S2, S3) are controlled to off states. In FIG. 6, only on control is shown and off control is not shown. That is, it may be assumed that when not described, the solenoid valve(s) is controlled to an off state(s).

Further, in step ST40, if the width of a steel sheet is 4W/6, the first solenoid valve (S1) is controlled to an on state, while the second and third solenoid valves (S2, S3) are controlled to off states. If the width of a steel sheet is 5W/6, the first and second solenoid valves (S1, S2) are controlled to on states, while the third solenoid valve (S3) is controlled to an off state. If the width of a steel sheet is 6W/6, the first, second, and third solenoid valves (S1, S2, S3) are controlled to on states.

If the solenoid valves are controlled according to the width detection signals, the nozzles connected to the solenoid valves that are on controlled spray lubricant in step ST50.

If the width of a steel sheet is 3W/6, lubricant is sprayed through the eleventh and twelfth nozzles (N11, N12) (see FIG. 2). At this time, the eleventh and twelfth nozzles (N11, N12) spray the mixture, while the twenty-first nozzle and twenty-second nozzle (N21, N22), the thirty-first nozzle and thirty-second nozzle (N31, N32), and the forty-first nozzle and forty-second nozzle (N41, N42) spray only water.

If the width of a steel sheet is 4W/6, lubricant is sprayed through the eleventh and twelfth nozzles (N11, N12) and the twenty-first and twenty-second nozzles (N21, N22) (see FIG. 3) as a result of the first solenoid valve (S1) being controlled to an on state. At this time, the eleventh and twelfth nozzles (N11, N12) and the twenty-first and twenty-second nozzles (N21, N22) spray the mixture, while the thirty-first nozzle and thirty-second nozzle (N31, N32), and the forty-first nozzle and forty-second nozzle (N41, N42) spray only water.

If the width of a steel sheet is 5W/6, lubricant is sprayed through the eleventh and twelfth nozzles (N11, N12), the twenty-first and twenty-second nozzles (N21, N22), and the thirty-first and thirty-second nozzles (N31, N32) (see FIG. 4) as a result of the first and second solenoid valves (S1, S2) being controlled to on states. At this time, the eleventh and twelfth nozzles (N11, N12), the twenty-first and twenty-second nozzles (N21, N22), and the thirty-first and thirty-second nozzles (N31, N32) spray the mixture, while the forty-first nozzle and forty-second nozzle (N41, N42) spray only water.

If the width of a steel sheet is 6W/6, lubricant is sprayed through the eleventh and twelfth nozzles (N11, N12), the twenty-first and twenty-second nozzles (N21, N22), the thirty-first and thirty-second nozzles (N31, N32), and forty-first and forty-second nozzles (N41, N42) (see FIG. 5) as a result of the first, second, and third solenoid valves (S1, S2, S3) being controlled to on states. At this time, the eleventh and twelfth nozzles (N11, N12), the twenty-first and twenty-second nozzles (N21, N22), the thirty-first and thirty-second nozzles (N31, N32), and the forty-first and forty-second nozzles (N41, N42) spray the mixture.

In the exemplary embodiments of the present invention described above, a plurality of nozzles are disposed corresponding to a maximum width of steel sheets, and a lubricant and water mixture is always sprayed through the nozzles positioned corresponding to a minimum width of the nozzles.

Further, according to the exemplary embodiments of the present invention, the nozzles disposed at a position between minimum and maximum widths of the steel sheets are selectively controlled by solenoid valves. As a result, the lubricant and water mixture is sprayed corresponding to the widths of the steel sheets, while water is sprayed through the nozzles disposed at areas outside of the widths of the steel sheets.

Hence, in the exemplary embodiments of the present invention, event when steel sheets of different widths are supplied during continuous rolling, lubricant is sprayed in an amount only as needed depending on the widths of the steel sheets, thereby reducing the consumption of the lubricant.

In addition, in the exemplary embodiments of the present invention, the number of steel sheets that can be continuously pressed is increased to thereby enhance productivity.

Also, according to the exemplary embodiments of the present invention, rotary flow dividers are disposed between the lubricant line and the sub lines corresponding to each of the nozzles. As a result, the lubricant may be supplied in more precise amounts.

Accordingly, the concentration of the lubricant may be maintained at a uniform level in the preferred embodiments of the present invention.

Although exemplary embodiments of the present invention have been described in detail hereinabove, it should be clearly understood that many variations and/or modifications of the basic inventive concept taught herein still fall within the spirit and scope of the present invention, as defined by the appended claims.

The invention claimed is:

1. A lubricant supply apparatus for endless hot rolling equipment, comprising:

a width-detecting sensor for detecting widths of steel sheets continuously supplied toward a roller in the endless hot rolling equipment;

a controller connected to the width-detecting sensor;

a lubricant pump connected to and controlled by the controller to supply a lubricant to a lubricant line;

a solenoid valve disposed on at least one of a plurality of sub lines formed by dividing the lubricant line, the solenoid valve being controlled by the controller so as to one of supply and cut off the supply of the lubricant;

a water pump connected to and controlled by the controller to supply water to a water line;

a plurality of mixers for mixing the lubricant and the water supplied to the water line respectively for the sub lines; and a plurality of nozzles connected respectively to the mixers and disposed according to a width of the roller;

wherein a mixture of the lubricant and the water is selectively sprayed onto the roller in response to the width of the steel sheets detected by the width-detecting sensor.

2. The lubricant supply apparatus of claim 1, wherein the nozzles include a fixed width nozzle disposed corresponding to a center portion of the steel sheets and spraying a large amount of the mixture, and variable width nozzles disposed outwardly of and sequentially from the fixed width nozzle and spraying a smaller amount of the lubricant than the fixed width nozzle.

3. The lubricant supply apparatus of claim 1, wherein the nozzles are symmetrically arranged along the direction of the width of the steel sheets, and include large flow eleventh and twelfth nozzles disposed corresponding to a center position of the width of the steel sheets, a twenty-first nozzle, a thirty-first nozzle, and a forty-first nozzle disposed in this order to one side of the eleventh and twelfth nozzles, and a twenty-second nozzle, a thirty-second nozzle, and a forty-second nozzle disposed in this order to an opposite side of the eleventh and twelfth nozzles, the twenty-first, twenty-second, thirty-first, thirty-second, forty-first, and forty-second nozzles spraying a smaller amount of the lubricant than the eleventh and twelfth nozzles.

4. The lubricant supply apparatus of claim 1, wherein rotary flow dividers are disposed between the lubricant line and the sub lines.

5. The lubricant supply apparatus of claim 4, wherein the lubricant line is divided into an eleventh sub line and a twelfth sub line by a tenth rotary flow divider.

6. The lubricant supply apparatus of claim 5, wherein the eleventh sub line is divided into a one hundred twenty-first sub line and a two hundred twenty-first sub line by a twenty-first rotary flow divider, the one hundred twenty-first sub line and the two hundred twenty-first sub line being connected respectively to the eleventh nozzle and the twelfth nozzle which are positioned corresponding to a center position of the width of the steel sheets.

7. The lubricant supply apparatus of claim 6, wherein an eleventh mixer connected to the water line is disposed between the one hundred twenty-first sub line and the eleventh nozzle, and a twelfth mixer connected to the water line is disposed between the two hundred twenty-first sub line and the twelfth nozzle.

8. The lubricant supply apparatus of claim 7, wherein the twelfth sub line is divided into a twenty-second sub line, a twenty-third sub line, and a twenty-fourth sub line by a twenty-second rotary flow divider.

9. The lubricant supply apparatus of claim 8, wherein the twenty-second sub line is divided into a one hundred twenty-third sub line and a two hundred twenty-third sub line by a twenty-third rotary flow divider, the one hundred twenty-third sub line and the two hundred twenty-third sub line being connected respectively to a twenty-first nozzle and a twenty-second nozzle positioned outwardly of the eleventh nozzle and the twelfth nozzle, respectively.

10. The lubricant supply apparatus of claim 9, wherein a first solenoid valve is disposed on the twenty-second sub line, the first solenoid valve being connected to the controller.

11. The lubricant supply apparatus of claim 9, wherein a twenty-first mixer connected to the water line is disposed between the one hundred twenty-third sub line and the twenty-first nozzle, and a twenty-second mixer connected to the water line is disposed between the two hundred twenty-third sub line and the twenty-second nozzle.

12. The lubricant supply apparatus of claim 8, wherein the twenty-third sub line is divided into a one hundred twenty-fourth sub line and a two hundred twenty-fourth sub line by a twenty-fourth rotary flow divider, the one hundred twenty-fourth sub line and the two hundred twenty-fourth sub line being connected respectively to a thirty-first nozzle and a thirty-second nozzle positioned outwardly of the twenty-first nozzle and the twenty-second nozzle, respectively.

13. The lubricant supply apparatus of claim 12, wherein a second solenoid valve is disposed on the twenty-third sub line, the second solenoid valve being connected to the controller.

14. The lubricant supply apparatus of claim 12, wherein a thirty-first mixer connected to the water line is disposed between the one hundred twenty-fourth sub line and the thirty-first nozzle, and a thirty-second mixer connected to the water line is disposed between the two hundred twenty-fourth sub line and the thirty-second nozzle.

15. The lubricant supply apparatus of claim 8, wherein the twenty-fourth sub line is divided into a one hundred twenty-fifth sub line and a two hundred twenty-fifth sub line by a twenty-fifth rotary flow divider, the one hundred twenty-fifth sub line and the two hundred twenty-fifth sub line being connected respectively to a forty-first nozzle and a forty-second nozzle positioned outwardly of the thirty-first nozzle and the thirty-second nozzle, respectively.

16. The lubricant supply apparatus of claim 15, wherein a third solenoid valve is disposed on the twenty-fourth sub line, the third solenoid valve being connected to the controller.

17. The lubricant supply apparatus of claim 15, wherein a forty-first mixer connected to the water line is disposed between the one hundred twenty-fifth sub line and the forty-first nozzle, and a forty-second mixer connected to the water line is disposed between the two hundred twenty-fifth sub line and the forty-second nozzle.

18. A lubricant supply method for endless hot rolling equipment including a lubricant supply apparatus as in claim 1, comprising:

(a) detecting widths of steel sheets continuously supplied toward a roller;

(b) driving a lubricant pump and a water pump according to detection signals;

(c) determining widths of the steel sheets according to the detection signals;

(d) on and off controlling solenoid valve disposed on sub lines that connect a lubricant line to each of the nozzles such that lubricant is sprayed from the nozzles positioned corresponding to the widths of the steel sheets; and (e) mixing the lubricant and water and selectively spraying a resulting mixture through corresponding nozzles in response to the width of the steel sheets detected.

19. The method of claim 18, wherein in step (c), it is determined if each of the widths (W) of the steel sheets is one of 3W/6, 4W/6, 5W/6, and 6W/6.

20. The method of claim 19, wherein in step (d), if the width of one of the steel sheets is 3W/6, first, second, and third solenoid valves are controlled to off states, if the width of one of the steel sheets is 4W/6, the first solenoid valve is controlled to an on state, while the second and third solenoid valves are controlled to off states, if the width of one of the steel sheets is 5W/6, the first and second solenoid valves are controlled to on states, while the third solenoid valve is controlled to an off state, and if the width of one of the steel sheets is 6W/6, the first, second, and third solenoid valves are controlled to on states.

* * * * *